US011563287B2

(12) United States Patent
Reichert et al.

(10) Patent No.: US 11,563,287 B2
(45) Date of Patent: Jan. 24, 2023

(54) ARRANGEMENT FOR MAKING ELECTRICAL CONTACT, AND CURRENT CONNECTOR

(71) Applicant: ZF Friedrichshafen AG, Friedrichshafen (DE)

(72) Inventors: Heinz Reichert, Markdorf (DE); Tobias Nusser, Friedrichshafen (DE); Oliver Küpfer, Gräfenberg (DE)

(73) Assignee: ZF FRIEDRICHSHAFEN AG, Friedrichshafen (DE)

( * ) Notice: Subject to any disclaimer, the term of this patent is extended or adjusted under 35 U.S.C. 154(b) by 0 days.

(21) Appl. No.: 17/266,340

(22) PCT Filed: Jul. 10, 2019

(86) PCT No.: PCT/EP2019/068472
§ 371 (c)(1),
(2) Date: Feb. 5, 2021

(87) PCT Pub. No.: WO2020/030371
PCT Pub. Date: Feb. 13, 2020

(65) Prior Publication Data

US 2021/0320447 A1 Oct. 14, 2021

(30) Foreign Application Priority Data

Aug. 7, 2018 (DE) ..... 10 2018 213 158.9

(51) Int. Cl.
*H01R 13/24* (2006.01)
*H01R 12/71* (2011.01)

(52) U.S. Cl.
CPC ..... *H01R 13/2464* (2013.01); *H01R 12/714* (2013.01); *H01R 13/2407* (2013.01)

(58) Field of Classification Search
CPC ..... H01R 13/2464; H01R 12/714; H01R 13/2407; H01R 2201/26; H01R 4/26; H01R 13/2492
See application file for complete search history.

(56) References Cited

U.S. PATENT DOCUMENTS 6,007,345 A * 12/1999 Francis ..... F16F 9/463 188/282.2
6,007,389 A * 12/1999 Weber ..... H01R 43/20 439/857

(Continued)

FOREIGN PATENT DOCUMENTS

DE 19946438 C1 5/2001
DE 102015201234 A1 7/2016

(Continued)

OTHER PUBLICATIONS

International Search Report (English Translation) PCT/EP2019/068472, dated Sep. 23, 2019. (2 pages).

(Continued)

*Primary Examiner* — Abdullah A Riyami
*Assistant Examiner* — Nelson R. Burgos-Guntin
(74) *Attorney, Agent, or Firm* — Dority & Manning, P.A.

(57) ABSTRACT

An arrangement for electrical contacting of a current connector (3) with a circuit arrangement (1) is provided. The current connector (3) includes at least one contact spring wire (5, 6) with an end contact (5*a*, 6*a*), which is configured for spring-loading, and the circuit arrangement (1) includes at least one contact point. The end contact (5*a*, 6*a*) and the contact point each form a spring pressure contact, and the end contact (5*a*, 6*a*) of the contact spring wire (5, 6) is configured as a bracket with an outer contact surface and at least one cutting edge arranged proximate the contact surface, which is engaged with the contact point.

13 Claims, 4 Drawing Sheets

(56) References Cited

U.S. PATENT DOCUMENTS 6,041,497 A * 3/2000 Nakagawa ..... H01R 4/4818 29/874
6,224,396 B1 * 5/2001 Chan ..... H05K 7/1069 439/71
6,379,162 B1 * 4/2002 Raypole ..... H01R 33/7664 188/282.2
6,454,060 B1 * 9/2002 Lisenker ..... F16F 9/53 188/266.2
9,761,520 B2 * 9/2017 Rathburn ..... H01L 23/49811
10,605,446 B2 3/2020 Eckert et al.
2002/0063025 A1 * 5/2002 Raypole ..... H01R 33/7664 188/322.19
2002/0127910 A1 9/2002 Loibl et al.
2002/0134627 A1 * 9/2002 Lisenker ..... F16F 9/463 188/322.12
2009/0127698 A1 * 5/2009 Rathburn ..... H01R 12/52 257/730
2010/0107407 A1 * 5/2010 Freakes ..... H01F 5/04 335/255
2010/0109698 A1 * 5/2010 Hsu ..... G01R 1/06744 29/842
2014/0273571 A1 * 9/2014 Iyer ..... H01R 13/53 439/485
2015/0072551 A1 * 3/2015 Schmidt ..... H01R 13/2428 439/395
2017/0117664 A1 * 4/2017 Yoshigi ..... H01R 12/58
2019/0027847 A1 * 1/2019 Lybrand ..... H01R 12/732
2019/0190207 A1 * 6/2019 Ju ..... H01R 13/646
2019/0372449 A1 * 12/2019 Mills ..... G21B 3/00
2019/0386411 A1 * 12/2019 Kikuchi ..... H01R 13/428
2020/0076101 A1 * 3/2020 Lybrand ..... H01R 13/245
2020/0153176 A1 * 5/2020 Sparrowhawk ..... H01R 13/64
2021/0028564 A1 * 1/2021 Moosmann ..... H01R 12/7076
2021/0183541 A1 * 6/2021 Mitchell ..... H01B 13/01209
2021/0265794 A1 * 8/2021 Diessl ..... H01R 13/6271
2021/0296808 A1 * 9/2021 Wang ..... H01R 4/28
2021/0336365 A1 * 10/2021 Iwasaki ..... H01R 13/2471
2022/0123488 A1 * 4/2022 Kimura ..... E05B 79/02

FOREIGN PATENT DOCUMENTS

DE 102015223779 A1 6/2017
DE 102017114730 A1 1/2019
DE 102018203970 A1 9/2019

OTHER PUBLICATIONS

German Search Report DE 10 2018 213 158.9, dated Jul. 8, 2019. (12 pages).

* cited by examiner

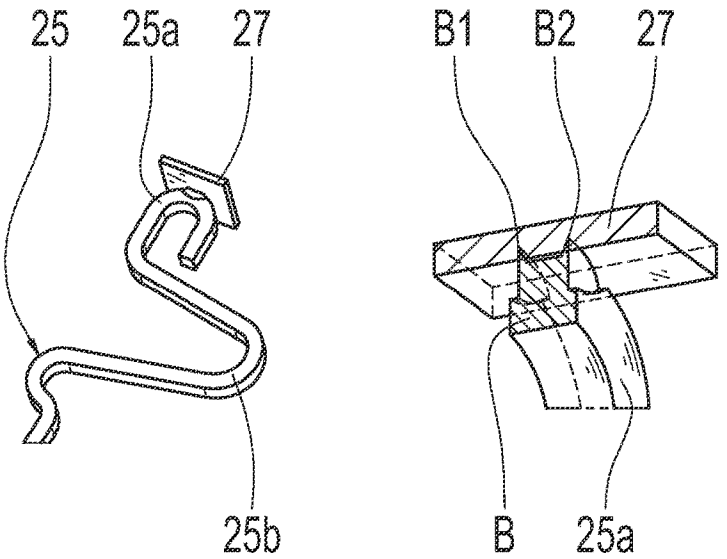
Fig. 5a
Fig. 5
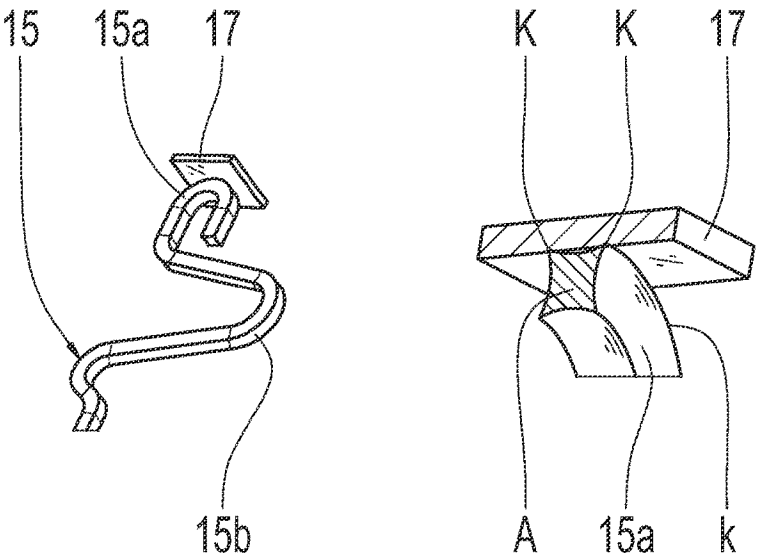
Fig. 4a
Fig. 4
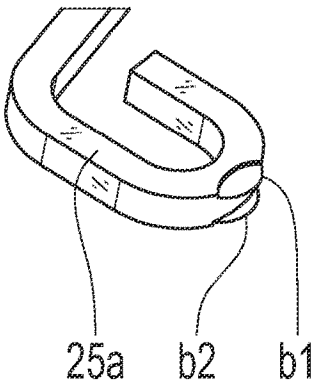
Fig. 5b
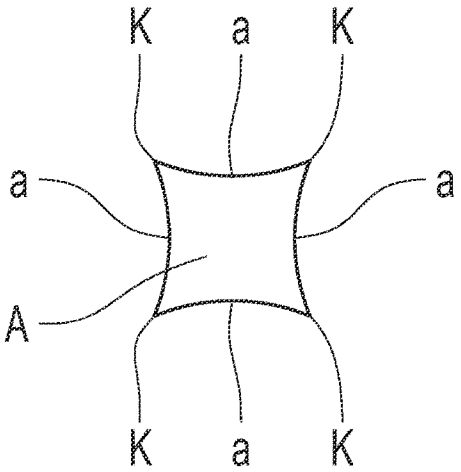
Fig. 4b

ARRANGEMENT FOR MAKING ELECTRICAL CONTACT, AND CURRENT CONNECTOR

CROSS-REFERENCE TO RELATED APPLICATIONS

The present application is related and has right of priority to German Patent Application No. 10 2018 213 158.9 filed on Aug. 7, 2018 and is a U.S. national phase of PCT/EP2019/068472 filed on Jul. 10, 2019, both of which are incorporated by reference in their entirety for all purposes.

FIELD OF THE INVENTION

The invention relates generally to an arrangement for the electrical contacting of a current connector with a circuit arrangement.

BACKGROUND

In 10 2018 203 970.4, a bridge element for establishing an electrical connection as well as an arrangement for the electrical connection of an actuator and a circuit arrangement by the bridge element are disclosed. The bridge element, which corresponds to a current connector, includes two contact spring wires, which are arranged and held in a housing. The bridge element contacts with first and second electrical contacts, which are formed at the contact spring wires, on the one hand, an actuator of a hydraulic control unit and, on the other hand, a circuit arrangement, preferably a printed circuit board, which contains an electronic transmission control unit. The contact between the contact spring wires and the circuit arrangement is designed as a spring pressure contact, wherein the spring force necessary for the contact pressure is applied via the design of the contact spring wire as a spring element. The counter-contact arranged on the printed circuit board for the contact spring wire is designed as a thickening of material or a contact pad, which forms a commercially available part of a printed circuit board and is connected to the conductors of the printed circuit preferably in an integrally bonded, i.e., electrically conductive, manner. A problem that occurs with respect to these types of electrical connections and contactings are vibrations, which occur, for example, during the operation of the automatic transmission of a motor vehicle. The vibrations can result in an adverse effect on the electrical contactings and, thereby, to a malfunction of the transmission control unit. Therefore, the contactings must be designed to be reliable and permanent.

Due to DE 199 46 438 C1, a configuration for the electrical contacting of a solenoid valve for automatic transmissions for motor vehicles became known. The configuration includes a contact housing, which is fixedly connected to the solenoid valve and in which a contact spring element is arranged, which is designed as a flat spring and includes a pressure section having a curved design, which is in pressure contact with a counter-contact element, a contact pad, on a printed circuit board. The contact pad is made of tin and is in electrical contact with a galvanized outer surface of the pressure section of the contact spring element. The pressure section having a curved design has a smooth-surfaced contact surface, at the lateral edges of which projecting hooks or claws are arranged, which, for example, are to dig into the counter-contact element and prevent the contact surface from slipping on the counter-contact surface.

SUMMARY OF THE INVENTION

Example aspects of the present invention provide an improved arrangement for the electrical contacting of a current connector with a circuit arrangement, wherein the current connector includes at least one contact spring wire with an end contact, which is designed to be spring-loaded, and the circuit arrangement includes at least one contact point, and wherein the end contact and the contact point form a spring pressure contact and a related current connector with electrical contactability.

According to a first example aspect of the invention, in an arrangement for the electrical contacting of a current connector with a circuit arrangement, it is provided that at least one cutting edge is arranged at the end contact of the contact spring wire, also referred to as a contact bracket, in the area of the contact surface, which is in engagement with the contact point, i.e., the at least one cutting edge digs into the surface of the contact point during the establishment of the electrical connection, which results in an anchoring of the cutting edge. Therefore, a minimal positive engagement is present, which prevents a relative movement between the two contacts when vibrations occur and, therefore, brings about a conservation of the contacts. This is an essential advantage for the surety and continuity of the electrical contact, via which control commands for actuating shift elements of an automatic transmission for motor vehicles travel. A circuit arrangement is also understood to be a circuit carrier or a printed circuit board with various contact points, in particular also a printed circuit board of an electronic transmission control unit.

According to one preferred example embodiment, the contact point is designed as a contact element, which is also referred to in the following—as is common in the technical terminology—as a contact pad, which represents a commercially available part, for example, in the form of a small plate, which is connected to a strip conductor or a component of the circuit arrangement or the printed circuit board in an electrically conductive manner, preferably in an integrally bonded manner. The dimensions of the contact pad are selected to be larger than those of the contact bracket, so that a clearance for a tolerance compensation is ensured during assembly. The material of the contact pad is relatively soft, for example, tin, so that the cutting edges can easily dig in and a planar contacting can take place on both sides of the cutting edges. The assembly of the current connector with the printed circuit board takes place in the known way known described above, in that the current connector, which preferably includes a housing with connecting elements, is connected with the printed circuit board, for example, via a snap-in or detent connection. Simultaneously, the necessary contact pressure is established via the contact spring wires, which are designed to be spring-loaded.

According to one further preferred example embodiment, the contact spring wire is designed as round wire. A wire with a circular cross-section is particularly cost-effectively manufacturable.

According to one further preferred example embodiment, the contact spring wire is designed as profiled wire, preferably with a square profile. The square profile offers the possibility, in a suitable way, to form the edges as cutting edges already during the manufacture of the profiled wire.

According to one further preferred example embodiment, the square profile is designed as a so-called cushion profile, i.e., between the edges, which are designed, in the cross-section, as tips, extend surfaces that are designed to be concave, i.e., inwardly (toward the center of the cross-section) curved, comparably to a hollow grinding between the edges of an ice skate. The cutting edges at the outer side of the contact bracket engage into the contact pad of the printed circuit example in a form-locking manner, wherein a certain stop is ensured due to the depth of the arch during the digging of the cutting edges into the contact pad. As a result, the cutting edges are prevented from digging too far into the contact pad.

According to further preferred example embodiments, the contact spring wire is manufacturable from stainless steel or from a copper alloy or from stainless steel with a copper sheathing. The material stainless steel has a relatively high modulus of elasticity, which conveys a high strength and resiliency to the wire for the application of the necessary contact pressure. Although a copper alloy has a lower modulus of elasticity, copper alloy has a better current conductivity, which can also be established by sheathing the stainless steel wire with copper.

According to one further preferred example embodiment, two cutting edges are arranged at the contact bracket in the area of the contact surface, which are manufacturable by stamping, i.e., via a plastic deformation of the wire cross-section. Preferably, a square cross-section is selected as the starting material, wherein two surfaces positioned opposite one another in parallel are crimped or compressed with a suitable tool or an appropriate device in such a way that the material yields or deforms outward, in the direction of the vertex of the contact bracket, and, there, forms outwardly projecting cutting edges. The cutting edges are therefore locally limited, i.e., the remaining cross-section of the contact spring wire remains unchanged. It is advantageous in this case that a commercially available profiled wire, in particular with a square profile, can be utilized.

According to one further preferred example embodiment, the cutting edges are designed in the shape of a crescent, i.e., the cutting edges have a smaller radius as compared to the radius of the contact bracket and project outward in a profiled manner, and so, during the installation of the current connector, the cutting edges first come into contact with the contact pad and, thereafter, dig into the surface of the contact pad and anchor there. Therefore, a locally limited, partial hook engagement or claw engagement is ensured. In addition, due to the stamping or the shaping, a further strain hardening of the contact bracket is achieved.

According to one further example aspect of the invention, in order to establish an electrical connection between a circuit arrangement, in particular a printed circuit board, and a solenoid valve or an actuator with a solenoid valve, a current connector includes a housing with two contact spring wires, which each include contact brackets with cutting edges, which are arranged at the ends and project out of the housing. As mentioned above and disclosed in the application described above, the housing preferably includes connecting elements, which permit a form-locking or friction-locking connection of the current connector with the printed circuit board. Therefore, the printed circuit board can be equipped with one or multiple current connector(s). Thereafter, the assembly with the solenoid valves of the actuators takes place. The actuators are generally arranged in a block, in particular a hydraulic control unit.

According to one further preferred example embodiment, the cutting edges are manufacturable by shaping the contact spring wire in the area of the contact bracket, i.e., only a locally limited shaping of the wire cross-section in the area of the contact bracket takes place. The preferred wire cross-section can be a circular cross-section or a square cross-section.

According to one further preferred example embodiment, the cutting edges are designed in the shape of a crescent, which results from the displacement of the material in the outer bending area of the contact bracket. Due to the crescent shape, this yields a reliable contacting of the current connector—which is insensitive to vibrations—with the contact pads of the printed circuit board as well as a conservation of the contacts.

BRIEF DESCRIPTION OF THE DRAWINGS

Exemplary embodiments of the invention are represented in the drawing and are described in greater detail in the following, wherein further features and/or advantages can result from the description and/or the drawing. Wherein FIG. 4 shows a contact spring wire with "cushion profile", FIG. 4*a* shows the contact zone between contact bracket and contact pad, FIG. 4*b* shows the cross-section of the "cushion profile", FIG. 5 shows a contact spring wire formed from square profile with contact pad, FIG. 5*a* shows the cross-section of contact bracket with crimped cutting edges, FIG. 5*b* shows the contact bracket with crescent-shaped cutting edges.

DETAILED DESCRIPTION

Figure 1B:
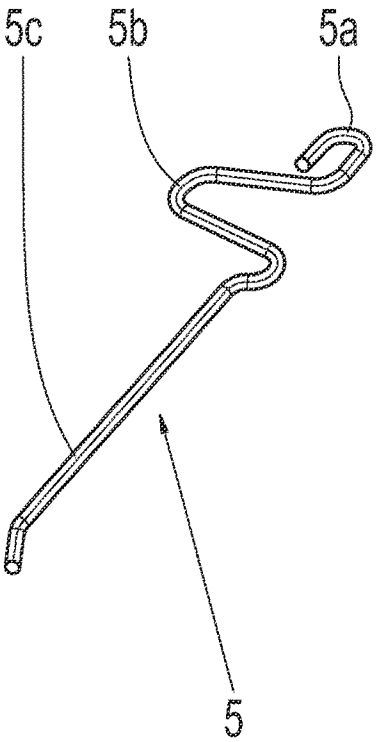
FIG. 1*b* shows a contact spring wire of the current connector.

Reference will now be made to embodiments of the invention, one or more examples of which are shown in the drawings. Each embodiment is provided by way of explanation of the invention, and not as a limitation of the invention. For example, features illustrated or described as part of one embodiment can be combined with another embodiment to yield still another embodiment. It is intended that the present invention include these and other modifications and variations to the embodiments described herein.

Figure 1A:
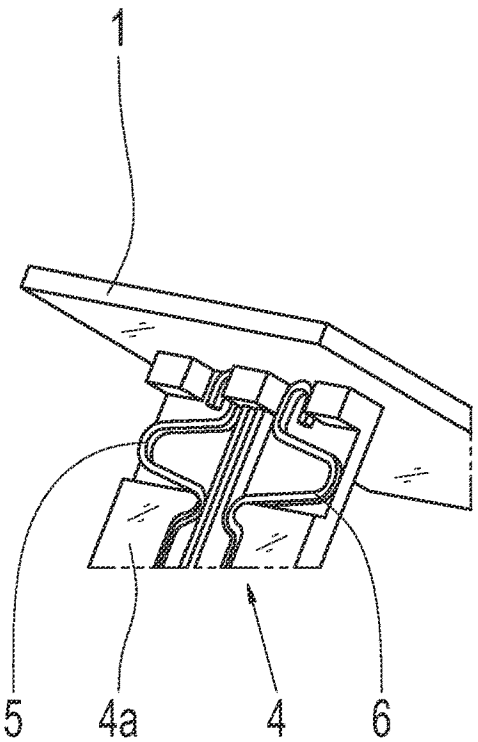
FIG. 1*a* shows the contact between the current connector and the printed circuit board.
Figure 1:
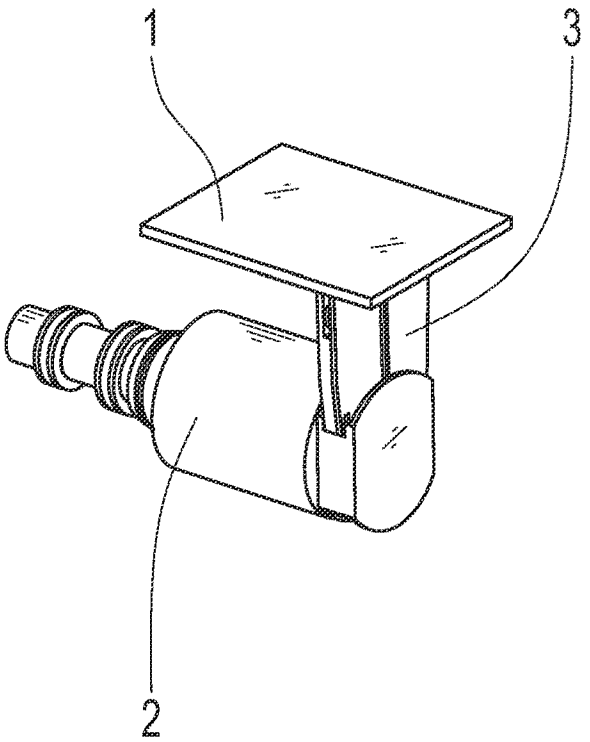
FIG. 1 shows an arrangement for the contacting of a solenoid valve with a printed circuit board via a current connector.

FIG. 1 shows an arrangement for establishing an electrical connection between a circuit arrangement 1 designed as a printed circuit board 1, which is also referred to as a circuit carrier 1, and a solenoid valve 2 via a current connector 3. This arrangement corresponds, in principle, to the arrangement of the type represented in FIG. 1 and FIG. 2 of the application mentioned above and described on pages 11 through 13. Reference is made to this disclosure for further details and relationships. Thus, DE 10 2018 203 970.4 is incorporated be reference in its entirety for all purposes.

In FIG. 1*a*, the portion of the current connector 3 connected to the printed circuit board 1 is represented, wherein one housing half 4*a* of a housing 4 (not completely represented) and two contact spring wires 5, 6 are apparent.

In FIG. 1*b*, the complete contact spring wire 5, which is manufactured from a round wire having a diameter of preferably one millimeter (1 mm), is represented as a single part. The contact spring wire 5 includes an end contact 5*a* designed in the shape of a bracket, an integrated spring element 5*b* designed as a bending spring, and a further contact 5*c*, which establishes an electrical connection to the solenoid valve 2. The contact spring wire 5 preferably is constructed of or with a stainless steel, has good elastic properties due to a relatively high modulus of elasticity, and can be sheathed with a copper alloy in a particularly preferred way, in order to achieve a good electrical conductivity. Alternatively, the contact spring wire can also be designed as a profiled wire, in particular with a square profile.

Figures 2, 3:
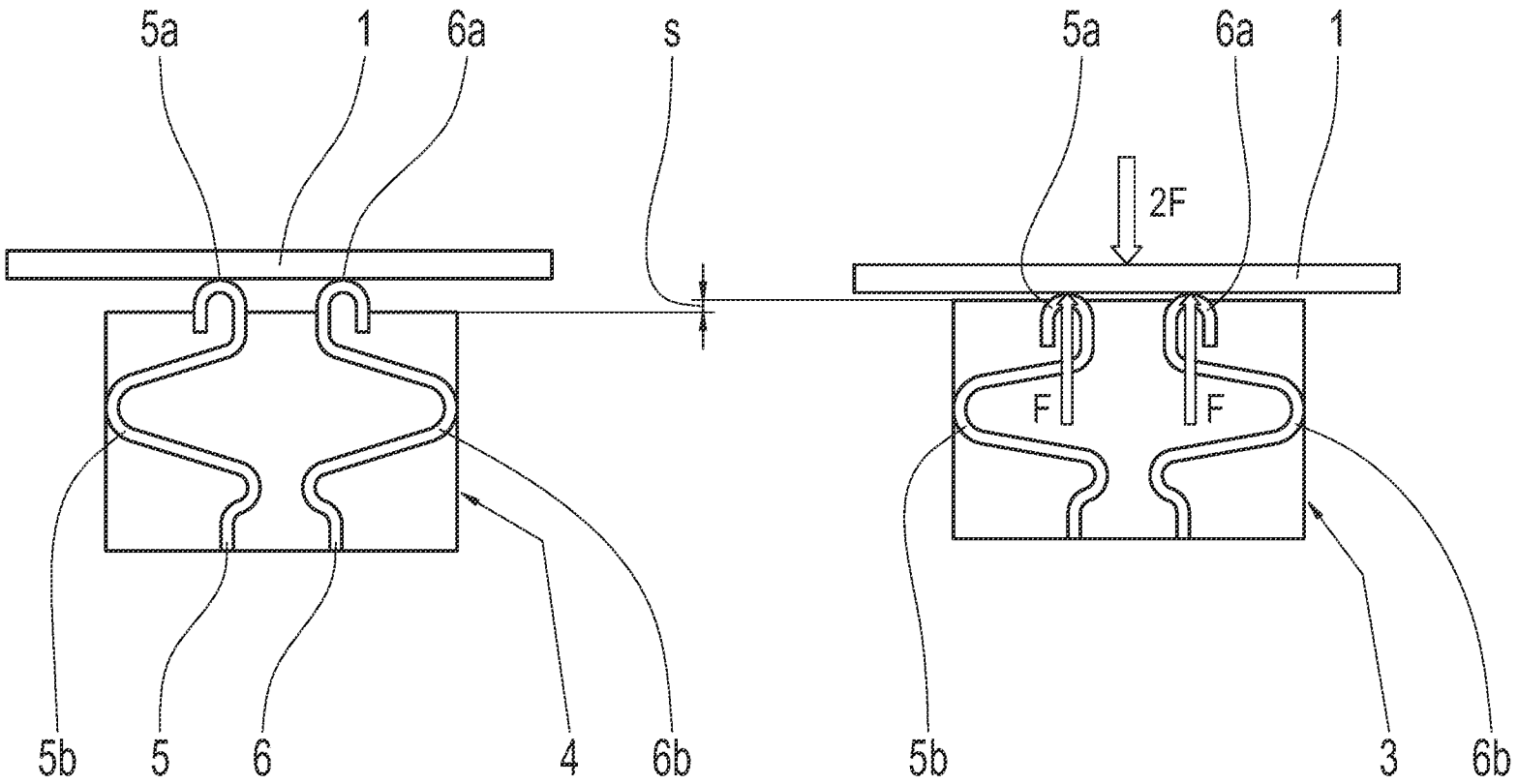
FIG. 2 shows the assembly of current connector and printed circuit board (first step: contact spring relaxed)
FIG. 3 shows the assembly of current connector and printed circuit board (second step: contact spring tensioned)

FIG. 2 shows, in a sectioning, the circuit carrier 1 or the printed circuit board 1, the housing 4 with one housing half, as well as the two contact spring wires 5, 6, which are arranged symmetrically with respect to one another and are arranged and fixed in the housing 4 of the current connector 3. Between the top edge of the housing 4 and the printed circuit board 1 there is a distance or gap s of approximately two millimeters (2 mm), wherein the two bracket-shaped end contacts 5*a*, 6*a*, which are also referred to simply as brackets or contact brackets 5*a*, 6*a*, extend beyond the top edge of the housing 4 and touch the printed circuit board 1. The spring elements 5*b*, 6*b* of the two contact spring wires 5, 6 are still relaxed in this arrangement, i.e., no pressure acts upon the printed circuit board 1 yet. The current connector 3 is not yet connected to the printed circuit board 1.

FIG. 3 shows the current connector 3 in a position, in which it is connected to the printed circuit board 1, whereby it is apparent that the gap s according to FIG. 2 has closed in FIG. 3, i.e., s=0. Due to the compression by the spring travel s, the two spring elements 5*b*, 6*b* are tensioned and each exert a spring force F, represented by two arrows F, onto the printed circuit board 1 via the contact brackets 5*a*, 6*a*, respectively. The reaction force acting upon the printed circuit board 1 is indicated by an arrow with the designation 2F. This reaction force is absorbed via fixing elements (not represented here), for example, snap-in elements at the housing 4 of the current connector 3 on the one hand and at the printed circuit board 1 on the other hand. In this context, reference is made once again to the aforementioned application, from which these types of connecting elements arise (pages 12, 13, FIGS. 2, 4). The two contact brackets 5*a*, 6*a* are pressed with a defined spring force of preferably eight newtons (8 N) to twelve newtons (12 N) at contact points (not represented here), in particular contact pads on the printed circuit board 1.

FIGS. 4, 4*a*, and 4*b* show a contact spring wire 15 formed from a square profile with a spring element 15*b* and a contact bracket 15*a*, which is in contact with a contact pad 17, wherein the contact bracket 15*a*, with the contact pad 17, forms a contact zone, which is delimited by the surface of the contact pad 17. As is apparent, in particular, from FIGS. 4*a* and 4*b*, the square profile is designed as a cushion profile with a cross-section A, wherein the cross-section A is delimited by four equally long, concavely designed surfaces or lateral lines a. The concavely designed lateral lines a (FIG. 4*b*) form four tips K, which form continuous cutting edges k (FIG. 4*a*). The inwardly curved lateral lines a between adjacent tips K are comparable to a hollow grinding between the edges (blades) of an ice skate. This type of profile is manufacturable as wire. FIG. 4*a* shows how two tips K and cutting edges k contact the contact pad 17, which is conductively connected to the printed circuit board (not represented here), wherein, due to the spring force of the contact bracket 15*a*, the cutting edges k dig into the contact surface of the contact pad 17 and anchor there. In FIG. 4*a*, it is apparent that the contact pad 17 is wider than the cross-section A of the contact bracket 15*a*. This has the advantage that transverse tolerances (perpendicular to the contact pressure) can be compensated for during assembly. According to one further advantage, if vibrations occur, relative movements between the contact bracket 15*a* and the contact pad 17 are avoided and the contacts are therefore conserved.

FIGS. 5, 5*a*, and 5*b* show, as a further exemplary embodiment of the invention, a contact spring wire 25 with a contact bracket 25*a* and a spring element 25*b*, bent in a U-shape, formed from a square profile, i.e., a profile with a square cross-section. The contact bracket 25*a* is in spring pressure contact with the contact pad 27, which is part of a printed circuit board (not represented here). FIG. 5*a* shows the design of the contact bracket 25*a*, i.e., the cross-section B of the contact bracket 25*a* in the contact area with the contact pad 27. The cross-section B has two tips B1, B2, which are manufactured via crimpings at the square cross-section in the contact area. In FIG. 5*b*, the contact bracket 25*a* is represented without the contact pad 27 and includes, in an apex area of the contact bracket 25*a*, i.e., the contact zone, two cutting edges b1, b2 designed in the shape of a crescent, which are apparently locally limited to the direct contact area with the contact pad. As mentioned above, the starting product is a wire with a square profile, which, after the bending of the contact bracket 25*a*, is plastically deformed in the apex area, for example, with a tool, which is active at both sides of the square profile and shapes the material of the wire in such a way that the two cutting edges b1, b2 (corresponding to the tips B1, B2 in FIG. 5*a*) are formed. As described in the preceding exemplary embodiment, the latter have the effect that the two cutting edges b1, b2 dig into the contact surface of the contact pad 27 and, therefore, prevent a relative movement when vibrations occur.

Figure 6A:
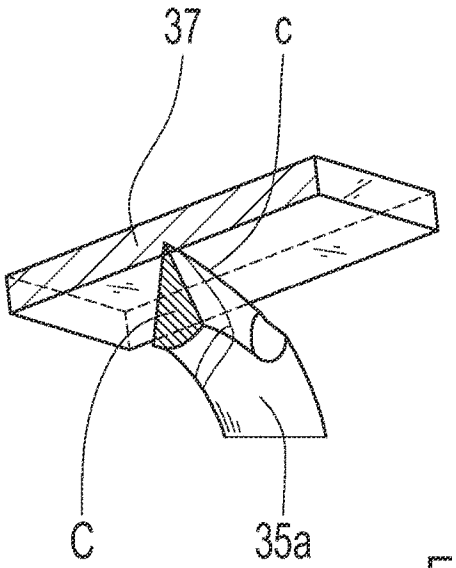
FIG. 6*a* shows the cross-section of contact bracket with a tip/cutting edge.
Figure 6B:
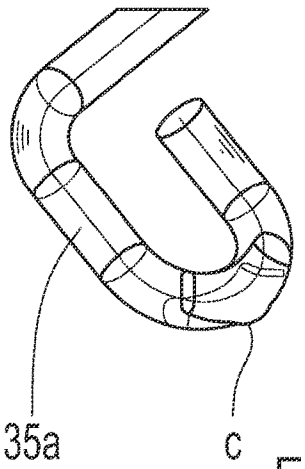
FIG. 6*b* shows the contact bracket with crescent-shaped cutting edge.
Figure 6:
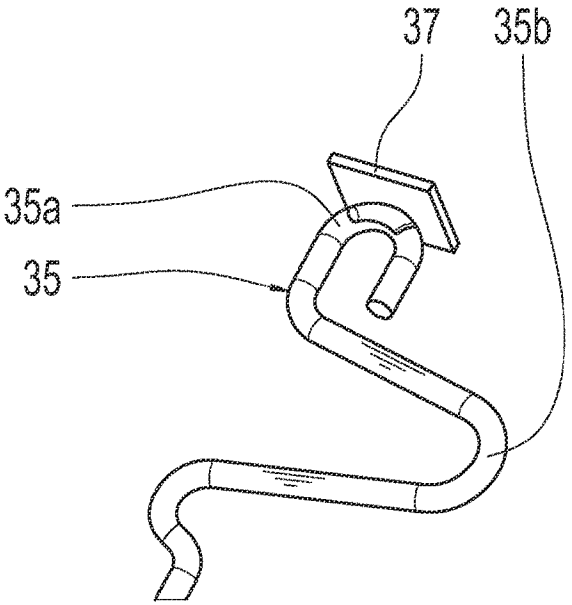
FIG. 6 shows a contact spring wire formed from round profile with contact pad.

FIGS. 6, 6*a*, 6*b* show one further embodiment of the invention with a contact spring wire 35 formed from a round profile. The contact spring wire 35 includes a contact bracket 35*a* bent in a U-shape and a spring element 35*b*, which generates the necessary contact pressure with respect to the contact pad 37. FIG. 6*a* shows the cross-section C of the contact bracket 35*a* in engagement with the contact pad 37. The cross-section C has a tip as part of a cutting edge c, which digs into the contact pad 37 and forms an anchoring. The cutting edge c is manufacturable by crimping lateral profiles into the round cross-section of the contact spring wire 35. FIG. 6*b* shows the contact bracket 35*a* with the cutting edge c, which is produced via partial shaping of the round cross-section and is designed in the shape of a crescent.

Modifications and variations can be made to the embodiments illustrated or described herein without departing from the scope and spirit of the invention as set forth in the appended claims. In the claims, reference characters corresponding to elements recited in the detailed description and the drawings may be recited. Such reference characters are enclosed within parentheses and are provided as an aid for reference to example embodiments described in the detailed description and the drawings. Such reference characters are provided for convenience only and have no effect on the scope of the claims. In particular, such reference characters are not intended to limit the claims to the particular example embodiments described in the detailed description and the drawings.

REFERENCE CHARACTERS

1 circuit carrier/printed circuit board
2 solenoid valve
3 current connector
4 housing
4*a* housing half
5 contact spring wire
5*a* end contact/contact bracket
5*b* spring element
5*c* further contact
6 contact spring wire
6*a* end contact
6*b* spring element
15 contact spring wire
15*a* end contact
15*b* spring element
17 contact pad
28 contact spring wire
25*a* end contact
25*b* spring element
27 contact pad
35 contact spring wire
35*a* contact bracket
35*b* spring element
37 contact pad
A wire cross-section ("cushion profile")
a lateral line
B wire cross-section (square)
B1 tip
B2 tip
b1 cutting edge
b2 cutting edge
C wire cross-section (round)
c cutting edge
F spring force
2F reaction force
K tip
k cutting edge
s gap

The invention claimed is:

1. An arrangement for making electrical contact between a current connector (3) and a circuit arrangement (1), the current connector (3) comprising a contact spring wire (5, 6, 15, 25, 35) with a spring-loadable end contact (5*a*, 6*a*, 15*a*, 25*a*, 35*a*), the circuit arrangement (1) comprising a contact point (17, 27, 37), wherein the end contact (5*a*, 6*a*, 15*a*, 25*a*, 35*a*) of the contact spring wire (5, 6, 15, 25, 35) and the contact point (17, 27, 37) of the circuit arrangement (1) form a spring pressure contact, and wherein the end contact (5*a*, 6*a*, 15*a*, 25*a*, 35*a*) of the contact spring wire (5, 6, 15, 25, 35) is configured as a bracket with an outer contact surface and at least one cutting edge (k, b1, b2, c), the at least one cutting edge (k, b1, b2, c) is arranged proximate the outer contact surface, and the at least one cutting edge (k, b1, b2, c) engaged with the contact point (17, 27, 37) of the circuit arrangement (1).

2. The arrangement of claim 1, wherein the contact point of the of the circuit arrangement (1) is configured as a contact element (17, 27, 37) electrically conductively connected with the circuit arrangement (1) via an integral bond.

3. The arrangement of claim 1, wherein the contact spring wire comprises a wire (5, 35) with a round profile.

4. The arrangement of claim 1, wherein the contact spring wire (15, 25) comprises a wire with a square profile (A, B).

5. The arrangement of claim 4, wherein the at least one cutting edge of the square profile (A, B) comprises a plurality of cutting edges (b1, b2, k).

6. The arrangement of claim 5, wherein the plurality of cutting edges (k) are shaped, in a cross-section, as tips (K), and a respective concave surface (a) is formed between each pair of adjacent tips (K).

7. The arrangement of claim 1, wherein the contact spring wire (5, 6, 15, 25, 35) is formed with stainless steel.

8. The arrangement of claim 7, wherein the stainless steel wire is sheathed with copper alloy.

9. The arrangement of claim 1, wherein the contact spring wire (5, 6, 15, 25, 35) is formed with copper alloy.

10. The arrangement of claim 1, wherein the at least one cutting edge comprises two stamped cutting edges (b1, b2) arranged proximate the contact surface (27).

11. The arrangement of claim 10, wherein the stamped cutting edges (b1, b2, c) are crescent shaped.

12. A current connector for establishing an electrical connection between a circuit arrangement (1) and a solenoid valve (2), comprising a housing (4) with two contact spring wires (5, 6), each of the contact spring wires (5, 6) comprising an end contact (5*a*, 6*a*) having a bracket shape, wherein a plurality of cutting edges (b1, b2, c) are arranged proximate the end contacts (5*a*, 6*a*), and wherein the cutting edges (b1, b2, c) are integrally formed on the contact spring wires (25, 35) by shaping the contact spring wires (25, 35) proximate the end contacts (25*a*, 35*a*).

13. The current connector of claim 12, wherein the cutting edges (b1, b2, c) are crescent shaped.

* * * * *